US006926013B2

(12) United States Patent
Martin et al.

(10) Patent No.: US 6,926,013 B2
(45) Date of Patent: Aug. 9, 2005

(54) APPARATUS AND METHODS FOR SHIELDING HIGH-PRESSURE FLUID DEVICES

(75) Inventors: Samuel A. Martin, Sugarland, TX (US); Leslie P. Antalffy, Houston, TX (US); Bruce A. Kerr, Sugarland, TX (US); Michael B. Knowles, Sugarland, TX (US); John W. Oder, Houston, TX (US); George T. West, Houston, TX (US)

(73) Assignee: Fluor Technolgies Corporation, Aliso Viejo, CA (US)

( * ) Notice: Subject to any disclaimer, the term of this patent is extended or adjusted under 35 U.S.C. 154(b) by 339 days.

(21) Appl. No.: 10/275,202

(22) PCT Filed: Feb. 27, 2001

(86) PCT No.: PCT/US01/06315

§ 371 (c)(1),
(2), (4) Date: Mar. 4, 2003

(87) PCT Pub. No.: WO02/16055

PCT Pub. Date: Feb. 28, 2002

(65) Prior Publication Data

US 2003/0213507 A1 Nov. 20, 2003

Related U.S. Application Data

(60) Provisional application No. 60/226,803, filed on Aug. 21, 2000.

(51) Int. Cl.[7] ..... B08B 9/093

(52) U.S. Cl. ..... 134/22.18; 134/167 R; 134/183

(58) Field of Search ..... 134/22.12, 22.18, 134/167 R, 167 C, 168 R, 168 C, 183; 196/122; 201/241; 239/456, 455, 589

(56) References Cited

U.S. PATENT DOCUMENTS

| | | | | | |
|---|---|---|---|---|---|
| 3,380,359 | A | * | 4/1968 | Landbrecht | 396/168 |
| 4,013,518 | A | * | 3/1977 | Miko | 202/241 |
| 4,611,613 | A | * | 9/1986 | Kaplan | 134/95.3 |
| 5,855,742 | A | * | 1/1999 | Lumbroso et al. | 202/241 |
| 6,652,714 | B1 | * | 11/2003 | Breaux | 202/241 |

FOREIGN PATENT DOCUMENTS

FR 1094729 A * 12/1954

* cited by examiner

*Primary Examiner*—Alexander Markoff
(74) *Attorney, Agent, or Firm*—Rutan & Tucker, LLP

(57) ABSTRACT

A high-pressure device has a drill stem (242) with a drill head (244) delivering a high-pressure fluid jet. A shield (246) is movably coupled to the device, wherein the drill head (244) is at least partially enclosed by the shield (246) when the drill head (244) is removed from the container (23).

20 Claims, 2 Drawing Sheets

APPARATUS AND METHODS FOR SHIELDING HIGH-PRESSURE FLUID DEVICES

This application is a 371 of PCT/US01/06315 filed Feb. 27, 2001 which claims benefit of application Ser. No. 60/226,803 filed Aug. 21, 2000.

FIELD OF THE INVENTION

The field of the invention is shielding of high-pressure fluid devices.

BACKGROUND OF THE INVENTION

There are numerous methods known in the art to disintegrate solid materials and deposits on surfaces, and many such methods include mechanical disintegration. While mechanical disintegration can be conceptually relatively simple, it often requires an operator in close proximity to the solid material or deposits, which may be particularly undesirable where the solid material or deposit is located in a hazardous environment (e.g., inside a coking vessel).

To circumvent at least some of the problems with disintegration of solid materials or deposits in hazardous environments, remote mechanical disintegration, preferably hydraulic cutting may be employed. For example, Novy describes in U.S. Pat. No. 3,880,359 (Apr. 29, 1975), which is incorporated by reference herein, a hydraulic cutting device that is employed in a preformed channel in a coking vessel. Novy's device effectively cuts the coke to allow removal of the coke from the drum, however, requires a preformed channel in which the cutting device operates.

Combined cutting devices have been developed that utilize drill heads, which perform both boring to form a channel and hydraulic cutting as disclosed in U.S. Pat. No. 4,611,613 to Kaplan (Sep. 16, 1986), U.S. Pat. No. 4,673,442 to Kaplan (Jun. 16, 1987), and U.S. Pat. No. 4,738,399 to Adams (Apr. 19, 1988), all of which are incorporated by reference herein. Although such combined cutting devices significantly improve a decoking operation, several disadvantages, particularly relating to the safety of the operator of hydraulic cutting devices still remain.

Among other things, the operator of the hydraulic cutting device is potentially exposed to the high-pressure fluid jet when the drill head is retrieved from the coking vessel (see Prior Art FIG. 1), and such exposure has resulted in several fatalities. In order to avoid potential exposure to the high-pressure fluid jet, automatic shut-off systems have been developed that cut off fluid supply to the drill head when the drill head is retrieved from the coking vessel or other containment. Although interrupting the fluid flow to the drill head is conceptually simple, such mechanisms provide only limited protection to the operator, especially when the fluid interrupt is defective.

Alternatively, insertion and retrieval of the drill head may be performed by the operator from a remote position. A remote position typically ensures safety of the operator, however, tends to be impracticable in many situations, especially when misalignment between the drill head/drill stem and the coking vessel occurs. In a further alternative method, the operator may temporarily move behind a protecting wall when the drill head is inserted and/or removed from the vessel, however, similar difficulties as with remote operation still remain.

Although various apparatus and methods for protection from high-pressure fluid jets are known in the, all or almost all of them suffer from one or more disadvantage. Therefore, there is still a need to provide apparatus and methods for shielding high-pressure fluid devices.

SUMMARY OF THE INVENTION

The present invention is directed to a high-pressure fluid jet device that has a drill stem (inlet duct) with a drill head (outlet nozzle) delivering a high-pressure fluid jet. A shield is movably coupled to the drill stem and/or drill head, and moves between a first position and a second position. The shield is in the first position when the drill head is removed from a container, and the drill head is at least partially enclosed by the shield when the shield is in the first position.

In one aspect of the inventive subject matter the drill stem is flexible, and contemplated drill heads deliver at least a second high-pressure fluid jet, wherein the drill head may further be configured to bore a channel into a solid phase (e.g., coke). The pressure of contemplated high-pressure fluid may vary considerably, however, especially contemplated pressures are between about 1,000 psi to about 10,000 psi, and more preferably between about 3,500 psi to about 5,000 psi. Particularly contemplated fluid jets comprise water, and disintegrate a deposit in the container (e.g., cutting coke in a decoking operation).

In another aspect of the inventive subject matter, the shield has a cylindrical horizontal cross section, is optionally collapsible, and is slidably coupled to the drill stem. The weight of contemplated shields is preferably at least partially supported by the container when the shield is in the second position, and at least partially supported by the drill stem when the shield is in the first position.

In a further aspect of the inventive subject matter, contemplated containers particularly include coke vessels and delayed coking vessels, however, alternative containers also include pipes, sewer lines, and containers employed in the food industry.

Various objects, features, aspects and advantages of the present invention will become more apparent from the following detailed description of preferred embodiments of the invention, along with the accompanying drawing.

DETAILED DESCRIPTION

As used herein, the term "high-pressure" generally refers to a pressure above about 100 psi, more preferably to a pressure of about 1,000 psi to about 10,000 psi, and most preferably to a pressure of between about 3,500 psi to about 5,000 psi.

As further used herein, the term "container" refers to any structure that at least temporarily retains a solid, fluid, gas, or any reasonable mixture thereof within the confines of at least one wall. Contemplated containers may further include tube or pipe-type extensions that are fluidly coupled to the structure. For example, an open or closed bottle is considered a container under the scope of this definition.

Figure 1:
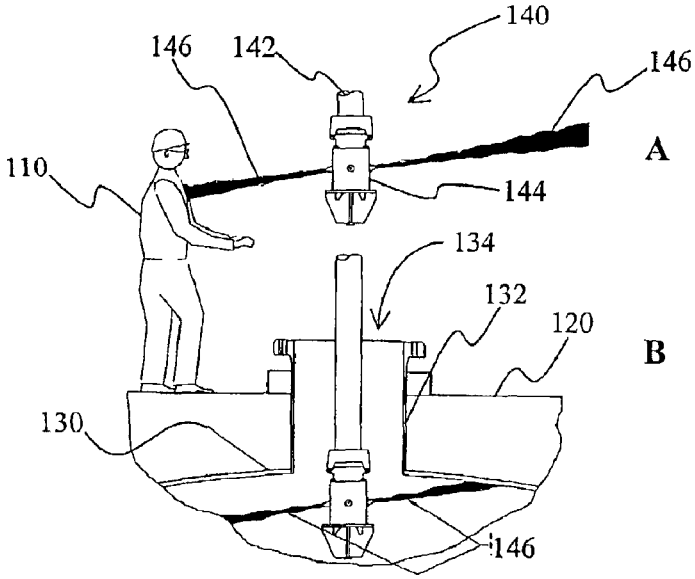
Figure 1 (Prior Art)
FIG. 1 is a sketch depicting manipulation of a prior art cutting/drilling system on a coke drum.

In prior art FIG. 1, an operator 110 stands on a structure 120, which is coupled to coking vessel 130. The operator 110 is in close proximity to the neck 132 having an opening 134 to introduce the cutting/drilling system 140 (comprising a drill stem 142 and a drill head 144) into the coking vessel 130. In the withdrawn position A, the high-pressure fluid jets 146 strike the operator 110. In the engaged position B, the drill head 144 and part of the drill stem 142 are disposed within the coking vessel 130, and the high-pressure fluid jets 146 strike the inside of the coking vessel 130.

Figure 2:
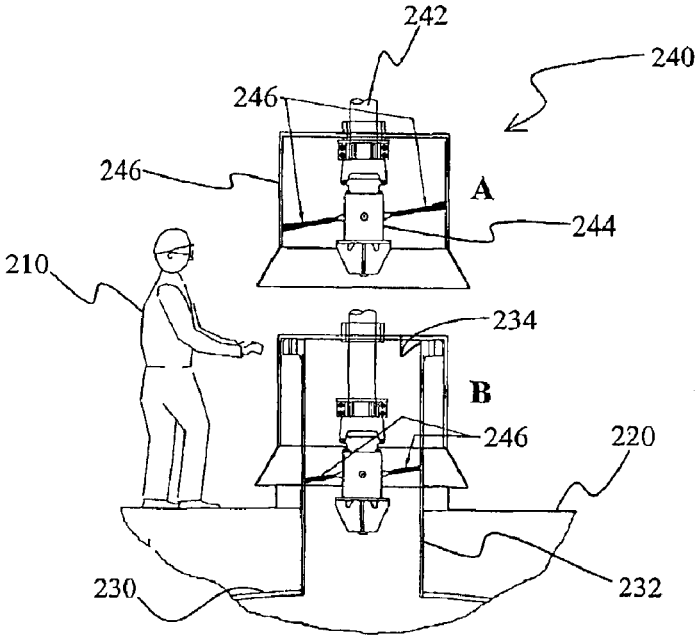
FIG. 2 is a sketch depicting manipulation of a cutting/drilling system with a shield on a coke drum.

In FIG. 2, an operator 210 stands on a structure 220, which is coupled to coking vessel 230. The operator 210 is in close proximity to the neck 232 having an opening 234 to introduce the cutting/drilling system 240 (comprising a drill stem 242, a drill head 244, and a movable shield 246) into the coking vessel 230. In the withdrawn position A, the high-pressure fluid jets 246 strike the inside of the shield 246. In the engaged position B, the shield rests on the neck 232, and the drill head 244 and part of the drill stem 242 are disposed within the coking vessel 230. The high-pressure fluid jets 246 strike the inside of the coking vessel 230.

It is generally preferred that the container is a coke drum or delayed coking vessel, with a capacity of about 20,000 to 80,000 cft. It should be appreciated, however, that the exact configuration and operation of alternative coking vessels is not limiting to the inventive subject matter, and it is contemplated that all known coking vessels are suitable in conjunction with the teachings presented herein. For example, appropriate coking vessels are described in U.S. Pat. No. 4,168,224 to Jansma (Sep. 18, 1979), U.S. Pat. No. 4,302,324 to Chen et al. (Nov. 24, 1981), and U.S. Pat. No. 4,547,284 to Sze, et al. (Oct. 15, 1985), all of which are incorporated by reference herein.

In alternative aspects of the inventive subject matter, it is contemplated that the container need not be restricted to a coke drum or delayed coking vessel, and particularly contemplated alternative containers include storage structures, process structures, and mass transport structures. For example, appropriate storage structures particularly include tanks, barrels, and bottles, wherein the volume of contemplated storage structures may vary considerably. For example, tanks may have a volume of about 10 cft to 100,000 cft, and more, while barrels and bottles may have a volume between about less than 0.1 cft and 10 cft. Similarly, the shape of suitable storage structures may vary substantially and contemplated shapes include round, cylindrical, cubic, and irregular shapes. Particularly contemplated process structures include chemical and biological reactors, and especially contemplated mass transport structures include pipes (e.g., a sewer pipe), lines, and ducts with various diameters and lengths. For example, suitable diameters include diameters of between less than ½ inch to more than several feet. It is generally contemplated that the pipes, lines, or ducts have a circular or otherwise rounded profile, alternative profiles including rectangular and irregularly shaped profiles are also contemplated. Likewise, the length of appropriate structures is not limiting to the inventive subject matter, and suitable lengths include lengths between about 1 inch and several 100 feet, and longer.

With respect to the drill stem and the drill head it is contemplated that all known drill stems and drill heads for decoking operations are suitable for use herein, and exemplary drill stem and drill heads can be found in U.S. Pat. No. 5,855,742 to Lumbroso et al. (Jan. 5, 1999) or U.S. Pat. No. 3,880,359 to Novi (Jan. 5, 1999), both of which are incorporated by reference herein. Particularly contemplated drill heads include drill heads that are configured to bore a channel into a solid phase (e.g., coke). It is still further contemplated, however, that suitable drill stems and drill heads need not be restricted to drill stems and heads in decoking operations, and numerous alternative configurations are also contemplated, so long as the drill stem provides fluid for the drill head and so long as the drill head produces at least one high-pressure fluid jet.

For example, where the container comprises a curved pipe, it is contemplated that the drill stem is fabricated from a flexible material that allows the drill stem to operate in a configuration other than a straight configuration. Consequently, alternative drill stems may comprise a pressure resistant pipe, which may be fabricated from natural and/or synthetic polymer with optional reinforcement, or may comprise rigid elements that are movably coupled to each other to provide at least some degree of flexibility. Similarly, the drill head may comprise one or more nozzles, which may deliver the high-pressure fluid jet in a patterned (e.g., jet fanning out to a brush) or focused fashion (e.g., jet concentrated to a beam). The term "fluid" as used herein refers to a liquid as well as a gas, wherein both the liquid and the gas may further comprise a solid phase. The term "jet" as used herein refers to a forceful stream of fluid discharged from an opening or nozzle.

With respect to the shield it is preferred that the shield is fabricated from stainless steel with a circular horizontal cross section having a diameter of about between 30 inches and 48 inches, and a height of about 30 inches and 42 inches. It is further preferred that (1) the shield is slidably coupled to the drill stem via a (optionally lubricated or with ball bearing) sleeve, (2) that the weight of the shield is supported by the neck portion of the vessel when the drill head and a portion of the drill stem is disposed within the container, and (3) that the weight of the shield is supported by the drill stem or the drill head (e.g., via a ring or other attachment structure) when the drill head and a portion of the drill stem are outside the container.

Figure 3A:
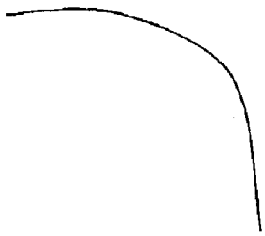
FIGS. 3A and 3B are horizontal cross sections of exemplary shields.
Figure 3B:
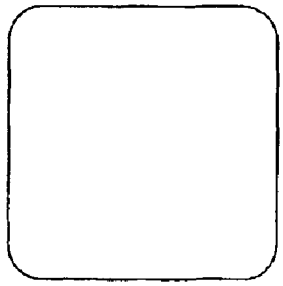

In alternative aspects of the inventive subject matter, the shield may have various forms other than a circular horizontal cross section with a diameter of about between 30 inches and 48 inches, and a height of about 30 inches and 48 inches, and alternative forms will predominantly be determined by the configuration of the drill stem, drill head and the container. Consequently, suitable shapes include symmetrical, non-symmetrical, and irregularly shaped forms. For example, where the container has a neck with a square-shaped horizontal cross section, alternative shields may have a corresponding square-shaped horizontal cross section. On the other hand, where the shape of the shield need not correspond to the neck or other portion of the container, an ellipsoid or irregular horizontal cross section are contemplated. It should further be appreciated that suitable shields may also have a discontinuous shape, including cutouts and perforations. For example, where appropriate, contemplated shields may not completely circumscribe the drill stem and drill head, but may circumscribe the drill stem and drill head only partially, and may further include a cutout window, or transparent elements. FIGS. 3A and 3B depict exemplary alternative shapes of shields in a horizontal cross section.

Likewise, the diameter or widest dimension of suitable shields need not be limited to 30 inches and 48 inches, and a height of about 30 inches and 42 inches, so long as the shield is movable between a first and second position, and so long as the drill head is at least partially enclosed by the shield. The term "drill head is at least partially enclosed by the shield" as used herein means that the shield occupies a space between the drill head and an operator in a manner such that a high-pressure fluid jet emanating from the drill head will strike the shield and not the operator. With respect to the material of the shield, it should be appreciated that many materials other than stainless steel are also appropriate, and suitable materials include metals, metal alloys, ceramics, carbon fiberglass, natural and synthetic polymers, and any reasonable combination thereof.

In still further contemplated alternative aspects of the inventive subject matter, it should be recognized that many suitable couplings other than the preferred coupling (supra) are also appropriate, and especially contemplated couplings include hydraulic couplings, rotatable couplings, and magnetic couplings, so long as such alternative couplings still allow the shield to move between a first position and a second position. Consequently, the weight of the shield may be supported by a structure other than the neck of the container when the drill head is disposed within the container (e.g., frame or scaffold extraneous to the container). Similarly, the weight of the shield may be supported by a structure other than the drill stem and/or drill head when the drill head is disposed outside the container (e.g., hydraulic or other actuator). Thus, the shield is typically in close proximity to the drill head (e.g., rests on top of the drill head, on top of the drill head coupling to the drill stem, or on the lower end of the drill stem) in the first position, and the shield is typically in a distal position relative to the drill head (e.g., rests on top of the neck of the container while the drill head is within the container) in the second position.

In further contemplated aspects of the inventive subject matter, the shield may comprise a collapsible or elastic portion, which may or may not functionally cooperate with the neck or other portion of the container. For example, where space saving is particularly desirable, the shield may comprise a series of interlocking rings (e.g., similar to a collapsible camping beaker). Alternatively, the shield may be coated with, comprise, or consist of a somewhat pliable material (i.e., material that absorbs energy by deformation without losing overall shape; e.g., a rubber bumper) to protect the operator or equipment from contact with sharp edges.

Thus, a method of shielding a high-pressure device comprises one step in which a drill stem with a drill head that delivers a high-pressure fluid jet is provided. In a further step, a shield is movably coupled to the drill stem or the drill head between a first position and a second position, wherein the shield is in the first position when the drill head is removed from a container, and wherein the drill head is at least partially enclosed by the shield when the shield is in the first position. With respect to the drill stem, the drill head, the high-pressure fluid jet, the container, and the shield, the same considerations as described above apply.

Thus, specific embodiments and applications for shielding high-pressure fluid devices have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. An apparatus comprising:

a drill stem with a drill head that delivers a high-pressure fluid jet;

a shield movably coupled to at least one of the drill stem and the drill head between a first position and a second position; and wherein the shield is in the first position when the drill head is removed from a container, and wherein the drill head is at least partially enclosed by the shield when the shield is in the first position.

2. The apparatus of claim 1 wherein the drill head delivers at least a second high-pressure fluid jet.

3. The apparatus of claim 1 wherein the drill head is configured to bore a channel into a solid phase.

4. The apparatus of claim 3 wherein the solid phase comprises a coke.

5. The apparatus of claim 1 wherein the high-pressure fluid jet has a pressure of about 1,000 psi to about 10,000 psi.

6. The apparatus of claim 1 wherein the high-pressure fluid jet has a pressure of about 3,500 psi to about 5,000 psi.

7. The apparatus of claim 1 wherein the high-pressure fluid jet comprises water.

8. The apparatus of claim 1 wherein the high-pressure fluid jet disintegrates a deposit in the container.

9. The apparatus of claim 1 wherein the high-pressure fluid jet cuts a coke in a decoking operation.

10. The apparatus of claim 1 wherein the shield has a cylindrical horizontal cross section.

11. The apparatus of claim 1 wherein the movable coupling of the shield comprises a slidable coupling of the shield to the drill stem.

12. The apparatus of claim 1 wherein the shield has a weight, and wherein the weight of the shield is at least partially supported by the container when the shield is in the second position.

13. The apparatus of claim 1 wherein the shield has a weight, and wherein the weight of the shield is at least partially supported by the drill stem when the shield is in the first position.

14. The apparatus of claim 1 wherein the container comprises a structure selected from the group consisting of a coke drum, a pipe, and a sewer line.

15. The apparatus of claim 1 wherein the container comprises a coking vessel, and wherein the high-pressure fluid jet cuts a coke in a decoking operation.

16. A method of shielding a high-pressure device, comprising:

providing a drill stem with a drill head that delivers a high-pressure fluid jet; and movably coupling a shield to at least one of the drill stem and the drill head between a first position and a second position, wherein the shield is in the first position when the drill head is removed from a container, and wherein the drill head is at least partially enclosed by the shield when the shield is in the first position.

17. The method of claim 16 wherein the container comprises a coke drum, and the shield circumferentially encloses the drill head.

18. The method of claim 17 wherein the shield has a weight that is at least partially supported by the container, when the shield is in the second position.

19. The method of claim 16 wherein the shield further operates a mechanism that interrupts a fluid supply, thereby shutting off the high-pressure fluid jet.

20. The method of claim 16 further comprising cutting a coke in the container with the high-pressure fluid jet, wherein the container comprises a coking vessel.

* * * * *